US009818390B1

(12) United States Patent
Kusakabe et al.

(10) Patent No.: US 9,818,390 B1
(45) Date of Patent: Nov. 14, 2017

(54) MEMORY DEVICE, WAVEFORM DATA EDITING METHOD

(71) Applicant: Roland Corporation, Shizuoka (JP)

(72) Inventors: Satoshi Kusakabe, Shizuoka (JP); Atsushi Hoshiai, Shizuoka (JP); Kenji Hirano, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 15/225,835

(22) Filed: Aug. 2, 2016

(51) Int. Cl.
*G10H 7/00* (2006.01)
*G10H 7/02* (2006.01)

(52) U.S. Cl.
CPC ..... *G10H 7/02* (2013.01); *G10H 2250/615* (2013.01); *G10H 2250/641* (2013.01)

(58) Field of Classification Search
CPC ..... G10H 7/02; G10H 2250/641; G10H 2250/615; G10H 2210/271; G10H 1/06
USPC ..... 84/603
See application file for complete search history.

(56) References Cited

U.S. PATENT DOCUMENTS 9,245,506 B2 1/2016 Nakata
2007/0107586 A1* 5/2007 Yip ..... G10H 7/105 84/627
2007/0175318 A1* 8/2007 Izumisawa ..... G10H 1/0091 84/626
2015/0228261 A1* 8/2015 Nakata ..... G10H 1/06 84/622

FOREIGN PATENT DOCUMENTS

JP S61-162094 7/1986
JP 2011-028290 2/2011

* cited by examiner

*Primary Examiner* — Jeffrey Donels
(74) *Attorney, Agent, or Firm* — JCIPRNET

(57) ABSTRACT

Provided are a memory device and waveform data editing method and editing program thereof. Waveform data obtained by sampling a musical sound is acquired, and a difference between a harmonic frequency of an $n^{th}$ harmonic of the waveform data and a resonance sound frequency of the $n^{th}$ harmonic sound of a resonance sound generation circuit is calculated, and if the difference is 1 Hz or more, a waveform of a frequency component of 20 Hz centered on a central of the frequency of the $n^{th}$ harmonic of a frequency spectrum is clipped. The difference calculated in regard to the clipped waveform is reduced. The waveform and the clipped original waveform are combined to edit the waveform data. Thus, in the waveform data, the difference between the harmonic frequencies of the resonance characteristic is eliminated, and resonance is facilitated and occurrence of beat of the sound is prevented.

8 Claims, 6 Drawing Sheets resonance sound frequency table 11d

| Key No. | fundamental sound frequency data (Hz) 11d1 | second harmonic frequency data (Hz) 11d2 | : | fifth harmonic frequency data (Hz) 11d5 | sixth harmonic frequency data (Hz) 11d6 | seventh harmonic frequency data (Hz) 11d7 | eighth harmonic frequency data (Hz) 11d8 |
|---|---|---|---|---|---|---|---|
| : | : | : | : | : | : | : | : |
| 60 | 261.63 | 523.26 | : | 1312.15 | 1574.78 | 1840.41 | 2103.04 |
| 61 | 277.18 | 554.36 | : | 1389.90 | 1668.08 | 1950.26 | 2228.44 |
| 62 | 293.66 | 587.32 | : | 1472.30 | 1766.96 | 2066.62 | 2361.28 |
| 63 | 311.13 | 622.26 | : | 1559.65 | 1871.78 | 2190.91 | 2503.04 |
| 64 | 329.63 | 659.26 | : | 1652.15 | 1982.78 | 2321.41 | 2653.04 |
| : | : | : | : | : | : | : | : |

MEMORY DEVICE, WAVEFORM DATA EDITING METHOD

BACKGROUND OF THE INVENTION

Field of the Invention

The invention relates to a memory device and waveform data editing method and editing program thereof. The memory device stores waveform data therein that facilitates resonance and prevents occurrence of beat of sounds without multiple resonance circuits or high-order APFs (All Pass Filter).

Description of Related Art

There are some electronic musical instruments which combine a sound source (PCM sound source) that samples the performance sound of a piano, for example, with a resonance sound generated by resonating the sampling sound source by a resonance sound generation circuit (e.g., DSP) to generate a musical sound. The frequencies of harmonics of the piano are slightly higher than the values of integer multiples of the frequency of the fundamental sound, and such a tendency becomes greater as the frequency increases. The phenomenon that the frequency of an $n^{th}$ harmonic (n is a positive integer not including 1) is slightly higher than a value that is n times the fundamental sound is called "inharmonicity (anharmonicity)." Inharmonicity results from physical characteristics, such as material and thickness of the strings.

On the other hand, the resonance sound generation circuit can carry inharmonicity due to intrinsic resonance characteristics. In that case, if there is a deviation between the frequency of the $n^{th}$ harmonic generated by the resonance sound generation circuit and the frequency of the $n^{th}$ harmonic inputted from the sampling sound source, resonance is less likely to achieve as the frequency deviation increases, and "beat" which is an uncomfortable sound to the listener will occur.

PRIOR ART LITERATURE

Patent Literature

[Patent Literature 1] Japanese Patent Publication No. 2011-028290

[Patent Literature 2] US Patent Publication No. 9245506

SUMMARY OF THE INVENTION

Problem to be Solved

Patent Literatures 1 and 2 have disclosed techniques for eliminating the deviation between the frequencies of the $n^{th}$ harmonic of the sampling sound and the $n^{th}$ harmonic of the resonance sound. According to the technique of Patent Literature 1, the $n^{th}$ harmonic is extracted one by one to design the resonance circuits and therefore it can match the frequency of the $n^{th}$ harmonic of the actual piano. Nevertheless, the technique of Patent Literature 1 faces the problem that many resonance circuits are required.

Moreover, according to the technique of Patent Literature 2, the circuit that generates an anharmonic resonance sound is provided with a high-order APF (All Pass Filter) to make the frequency of the $n^{th}$ harmonic of the resonance sound match the frequency of the $n^{th}$ harmonic of the sampling sound with inharmonicity. This method, however, has the problem that it requires the high-order APF. In addition, even with use of the high-order APF, for example, the frequencies of the $n^{th}$ harmonic may not completely match each other in the region of high frequencies. This is because the difference between the frequency of the $n^{th}$ harmonic that results from inharmonicity of the sampling sound and the value of the integer multiple of the frequency of the fundamental sound is not necessarily constant or does not necessarily increase as the frequency of the $n^{th}$ harmonic rises.

In view of the foregoing problems, the invention provides a memory device and waveform data editing method and editing program thereof. The memory device stores waveform data therein that achieves favorable resonance and prevents occurrence of beat of the sounds without multiple resonance circuits or high-order APFs.

Solution to the Problem

Accordingly, a memory device of the invention is adapted for a resonance sound generation circuit and stores waveform data edited by using: a waveform acquisition step of acquiring waveform data including a fundamental sound and an $n^{th}$ harmonic obtained by sampling a musical sound; a spectrum calculation step of calculating a frequency spectrum of the waveform data acquired by the waveform acquisition step; a difference calculation step of calculating a difference between a harmonic frequency of the $n^{th}$ harmonic of the frequency spectrum calculated by the spectrum calculation step and a resonance sound frequency of the $n^{th}$ harmonic of the resonance sound generation circuit; and a difference reduction step of performing a reduction process of the difference between the frequencies on a waveform of a frequency component having a second predetermined frequency width centered on the frequency of the $n^{th}$ harmonic of the frequency spectrum if the difference calculated by the difference calculation step is equal to or more than a first predetermined frequency difference (n is a positive integer not including 1).

The waveform data editing method and editing program adapted for the resonance sound generation circuit according to the invention include the waveform acquisition step, the spectrum calculation step, the difference calculation step, and the difference reduction step.

In addition, the difference reduction step includes: a waveform clipping step of clipping the waveform of the frequency component having the second predetermined frequency width centered on the frequency of the $n^{th}$ harmonic of the frequency spectrum from the frequency spectrum if the difference calculated by the difference calculation step is equal to or more than the first predetermined frequency difference; a waveform correction step of performing the reduction process of the difference calculated by the difference calculation step on the waveform clipped by the waveform clipping step; and a waveform combination step of combining the waveform corrected by the waveform correction step with the original waveform clipped by the waveform clipping step.

Further, the waveform correction step performs the correction by the following equation 1 where a frequency of the difference calculated by the difference calculation step is x [Hz], the waveform clipped by the waveform clipping step is P(t), a waveform obtained by rotating a phase of P(t) 90° is Q(t), and the corrected waveform is Y(t):

$$Y(t)=P(t)\cos \omega t+Q(t)\sin \omega t \qquad \text{equation 1}$$

($\omega=2\pi x/fs$, fs: a sampling frequency of the resonance sound generation circuit).

Moreover, the first predetermined frequency difference is less than a frequency of the second predetermined frequency width.

Effects of the Invention

The waveform data stored in the memory device adapted for the resonance sound generation circuit according to the invention is edited by using the following steps. First, by the waveform acquisition step, the waveform data obtained by sampling a musical sound is acquired, and the frequency spectrum of the acquired waveform data is calculated by the spectrum calculation step. The difference between the harmonic frequency of the $n^{th}$ harmonic (n is a positive integer not including 1) of the calculated frequency spectrum and the resonance sound frequency of the $n^{th}$ harmonic of the resonance sound generation circuit is calculated by the difference calculation step. If the calculated difference is equal to or more than the first predetermined frequency difference, by the difference reduction step, the reduction process of the difference between the frequencies is performed on the waveform of the frequency component having the second predetermined frequency width centered on the frequency of the $n^{th}$ harmonic of the frequency spectrum.

The waveform data obtained by sampling the musical sound is edited so as to eliminate the difference between the frequency of the $n^{th}$ harmonic thereof and the resonance frequency of the $n^{th}$ harmonic of the resonance sound generation circuit that uses the waveform data. Thus, with the use of the memory device storing the waveform data, there is no difference between the frequency of the $n^{th}$ harmonic of the sampling sound source and the resonance frequency of the $n^{th}$ harmonic of the resonance sound generated by the resonance sound generation circuit by resonating the sampling sound source thereof, and resonance is facilitated and occurrence of beat of the sound is also prevented. In addition, since the frequency of the $n^{th}$ harmonic of the sampling sound source is edited to match the resonance frequency of the $n^{th}$ harmonic of the resonance sound generation circuit that uses the sampling sound source thereof, multiple resonance circuits or high-order APFs are not required and costs of the resonance sound generation circuit are reduced.

Likewise, with the waveform data editing method and editing program adapted for the resonance sound generation circuit according to the invention, it is possible to edit the waveform data that achieves the aforementioned effects.

BRIEF DESCRIPTION OF THE DRAWINGS

FIG. 2(*b*) is a perspective view of the electronic piano that plays waveform data edited by the editing program.

FIG. 3(*b*) is a graph showing the frequency spectrum thereof and the resonance characteristic of the resonance sound generated by the resonance sound generation circuit.

FIG. 4(*b*) is a diagram schematically illustrating the resonance sound frequency table.

FIG. 4(*c*) is a block diagram showing an electrical configuration of the electronic piano.

FIG. 6(*b*) is a graph showing the frequency spectrum of the piano sound after frequency correction and the resonance characteristic of the resonance sound generated by the resonance sound generation circuit.

DESCRIPTION OF THE EMBODIMENTS

Hereinafter exemplary embodiments of the invention are described with reference to the affixed figures. In an electronic piano 2, a waveform that is generated from waveform data actually recorded from a piano is inputted to a resonance sound generation circuit x24 configured in a digital signal processor 26 (referred to as DSP 26 hereinafter) of the electronic piano 2 to generate a resonance sound, and the resonance sound is mixed with a piano sound of the waveform data and sounded, so as to generate a tone including a resonance sound close to that of the actual piano. Generation of the resonance sound is explained with reference to FIG. 1.

Figure 1:
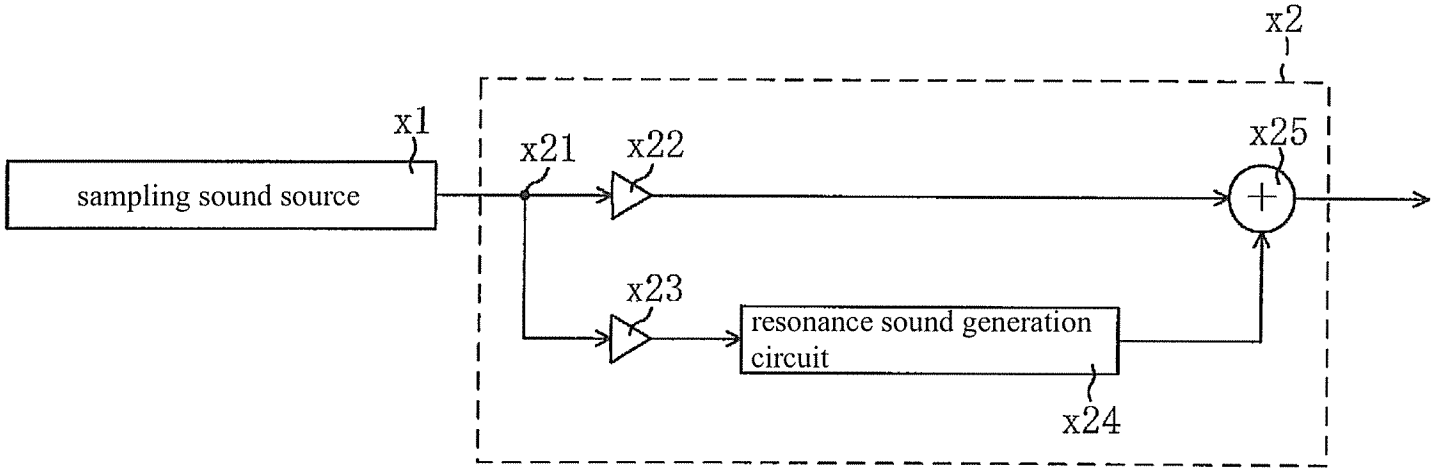
FIG. 1 is a schematic diagram for illustrating generation of the resonance sound.

FIG. 1 is a schematic diagram for illustrating generation of the resonance sound. A DSP x2 mixes a waveform inputted from a sampling sound source x1 with a waveform of a resonance sound generated in a DSP x2 based on the waveform from the sampling sound source x1, and outputs the mixture. The DSP x2 includes a branch x21 that branches the waveform inputted from the sampling sound source x1 into two, amplifiers x22 and x23 that amplify an amplitude of the waveforms, the resonance sound generation circuit x24, and an adder x25 that adds the two waveforms. The resonance sound generation circuit x24 is a circuit for generating a resonance sound based on the inputted waveform and includes a conventional "delay feedback circuit" (as shown in FIG. 1 of Japanese Patent No. S61-162094, for example). The delay feedback circuit includes a circuit that combines a delay line and an APF (All Pass Filter) for adjusting a base frequency of the resonance sound, and an APF for forming inharmonicity (anharmonicity), which will be described later.

The waveform inputted from the sampling sound source x1 is branched by the branch x21 into a waveform to be inputted to the resonance sound generation circuit x24 and a waveform to be inputted to the adder x25 directly. The amplitudes of the waveforms branched by the branch x21 are amplified by the amplifiers x22 and x23 respectively. The waveform amplified by the amplifier x23 is inputted to the resonance sound generation circuit x24 for the resonance sound generation circuit x24 to generate the resonance sound. The resonance sound and the waveform amplified by the amplifier x22 (i.e., the waveform inputted from the sampling sound source x1) are added by the adder x25 to be emitted (outputted).

Figures 4A, 4B, 4C:
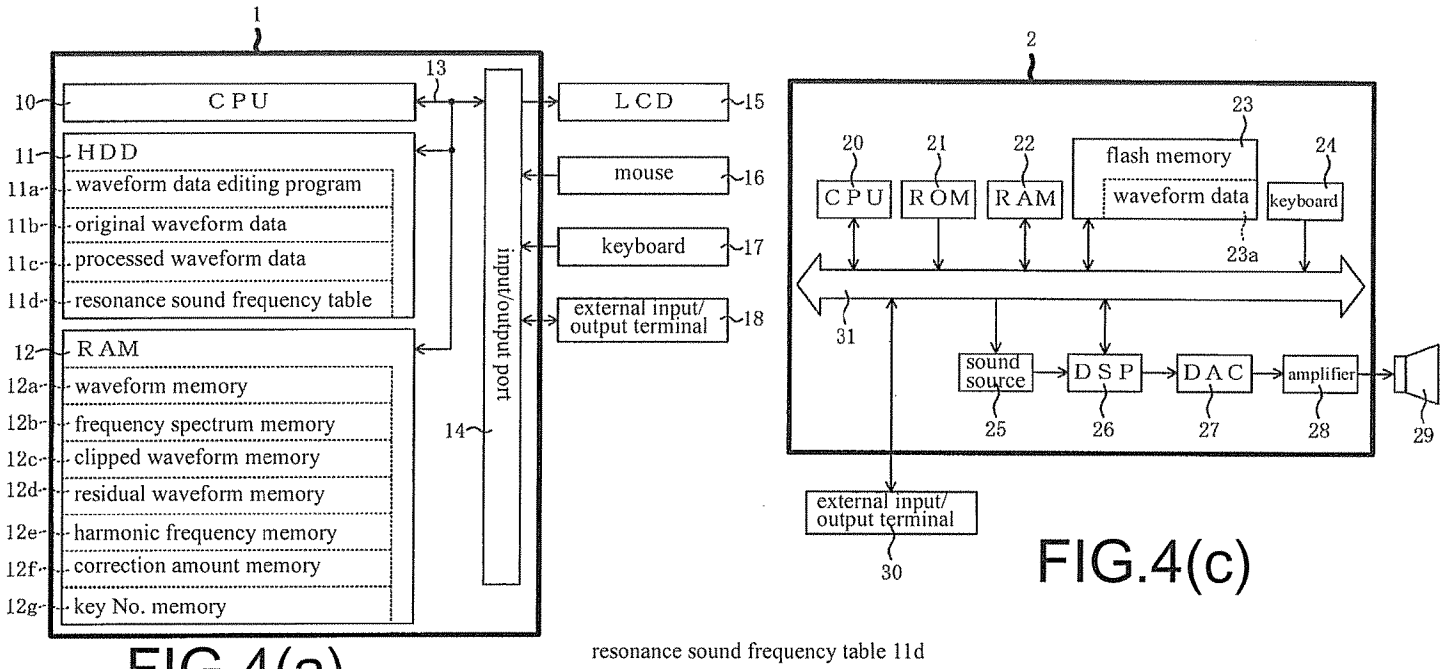
FIG. 4(*a*) is a block diagram showing an electrical configuration of the PC.

In this embodiment, the sampling sound source x1 corresponds to a flash memory 23 and a sound source 25 (refer to FIG. 4(*c*)) while the DSP x2 corresponds to the DSP 26 (refer to FIG. 4(*c*)). The DSP 26 includes the branch x21, the amplifiers x22 and x23, the resonance sound generation circuit x24, the adder x25, and so on.

In this embodiment, a waveform data editing program 11*a* is described, which corrects a frequency of a harmonic of the waveform data (referred to as original waveform data hereinafter) obtained from the piano, etc. according to a frequency of the resonance sound generated by the resonance sound generation circuit x24 of the electronic piano 2, so as to generate waveform data that matches the frequency of the resonance sound from the resonance sound generation circuit x24.

Figure 2A:
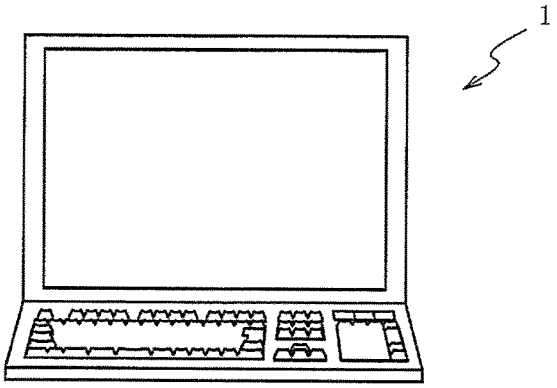
FIG. 2(*a*) is a front view of a PC that executes the waveform data editing program according to an embodiment of the invention.
Figure 2B:
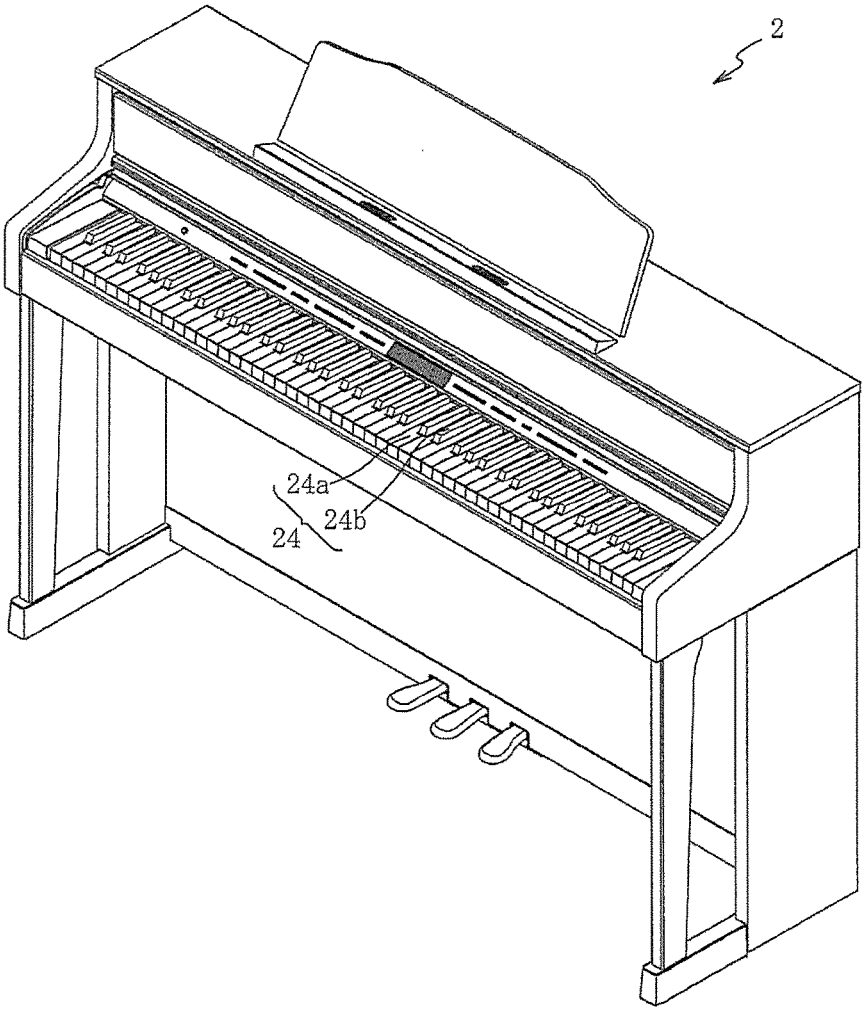

Referring to FIG. 2(*a*) and FIG. 2(*b*), an information processing apparatus for executing the waveform data editing program 11*a*, and a schematic view of the electronic piano 2 for playing the waveform data generated (edited) by the waveform data editing program 11*a* are illustrated. FIG. 2(*a*) is a front view of the information processing apparatus that executes the waveform data editing program 11*a*, and FIG. 2(*b*) is a perspective view of the electronic piano 2 that plays the waveform data generated (edited) by the waveform data editing program 11*a*.

A personal computer (referred to as PC hereinafter) 1 is the information processing apparatus, in which the waveform data editing program 11*a* of this embodiment is executed. The electronic piano 2 is an electronic keyboard instrument that includes a keyboard 24 composed of a plurality of keys 24*a* and keys 24*b*. The keyboard 24 has 88 keys. When any of the keys 24*a* or the keys 24*b* is operated, waveform data that matches the operated key is retrieved from waveform data 23*a* of the flash memory 23 (refer to FIG. 4(*c*)) and inputted to the sound source 25 (refer to FIG. 4(*c*)), and then emitted (outputted) by a speaker 29 (refer to FIG. 4(*c*)) as a musical sound. The waveform data with corrected frequency, which is generated by executing the waveform data editing program 11*a* in the PC 1, is stored in the waveform data 23*a* of the flash memory 23 of the electronic piano 2 via an external input/output terminal 18 of the PC 1 (refer to FIG. 4(*c*)) and an external input/output terminal 30 of the electronic piano 2 (refer to FIG. 4(*c*)).

Figure 3A:
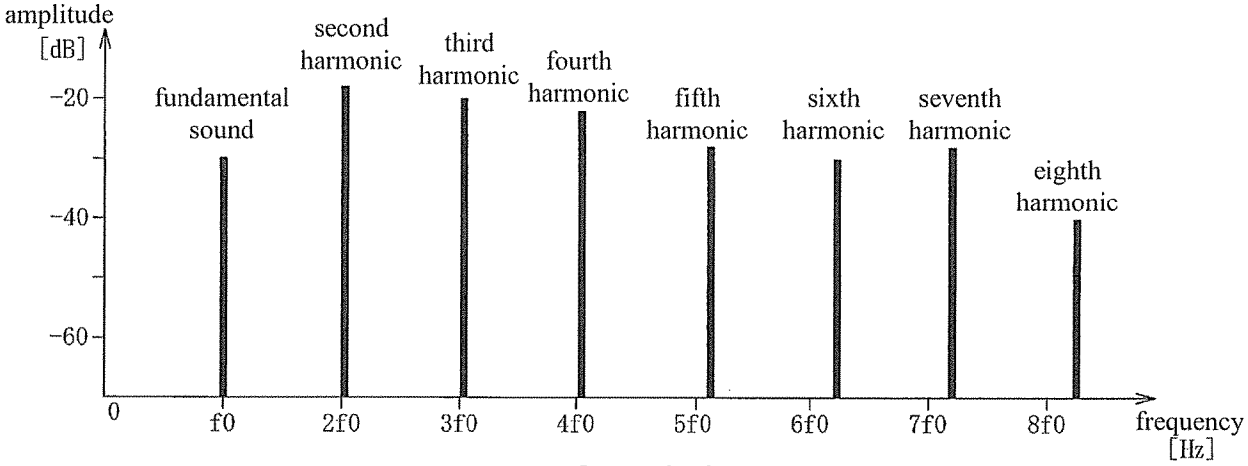
FIG. 3(*a*) is a graph showing the frequency spectrum of a piano sound.
Figure 3B:
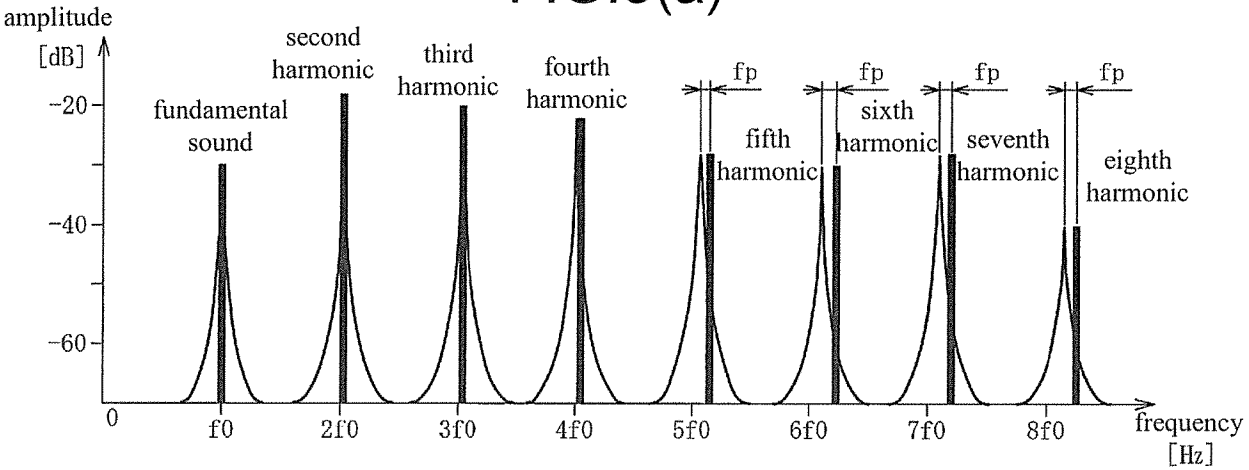

Next, referring to FIG. 3(*a*) and FIG. 3(*b*), a relationship between a frequency spectrum (i.e., amplitude characteristic of each frequency) of the original waveform data and a resonance characteristic of the resonance sound generated by the resonance sound generation circuit x24 of the electronic piano 2 is described with reference to FIG. 3(*a*) and FIG. 3(*b*). FIG. 3(*a*) is a graph showing the frequency spectrum of a piano sound. In FIG. 3(*a*), the horizontal axis indicates the frequency (Hz) and the vertical axis indicates the amplitude (dB). The piano sound is mainly composed of a sound of a frequency called "fundamental sound" (f0 of FIG. 3(*a*)) and sounds of multiple frequencies called "harmonics." In FIG. 3(*a*), the amplitude of each frequency of the fundamental sound and multiple harmonics of the piano is represented by a thick line. Although the piano sound also includes frequencies other than the frequency components of the fundamental sound and the multiple harmonics, only the frequencies of the fundamental sound and the harmonics are shown in the figure for the purpose of explanation (the same applies to the other figures below). As shown in FIG. 3(*a*), the frequencies of the harmonics are not strictly integer multiples of the frequency f0 of the fundamental sound and are slightly greater. Such a relationship between the frequencies of the harmonics and the frequency of the fundamental sound is called "inharmonicity (anharmonicity)." Generally, inharmonicity results from physical characteristics of the piano, such as material and thickness of the strings.

FIG. 3(*b*) is a graph showing the frequency spectrum of the piano sound and the resonance characteristic of the resonance sound generated by the resonance sound generation circuit x24. Same as FIG. 3(*a*), in FIG. 3(*b*), the horizontal axis indicates the frequency (Hz) and the vertical axis indicates the amplitude (dB), and the amplitude characteristic of each frequency of the fundamental sound and the multiple harmonics of the piano is represented by a thick line. In addition, the amplitude characteristic of each frequency of the fundamental sound and multiple harmonics of the resonance sound is represented by a solid line. A difference between the frequencies of the fundamental sound and multiple harmonics and the frequencies of the resonance sound of the fundamental sound and multiple harmonics is set as fp. The resonance sound generation circuit x24 (refer to FIG. 1) generates the resonance sound by processing the original waveform data of the piano sound inputted. The amplitude characteristic of each frequency of the resonance sound begins to increase before the frequencies of the fundamental sound and the multiple harmonics and reaches a peak around the frequency, and thereafter decreases. As shown in FIG. 3(*b*), substantially the difference fp does not exist between the frequencies of the fundamental sound and harmonics of the piano and the respective peak frequencies of the resonance sound until the fourth harmonic. However, the difference fp increases gradually between the fifth and the eighth harmonics. This is caused by the intrinsic resonance characteristic of the resonance sound generation circuit x24. Because the piano sound and the resonance sound are mixed to be outputted, the two sounds interfere with each other and do not achieve resonance easily. As the difference fp increases, it will become an uncomfortable "beat" for the user or audience. Thus, the waveform data editing program 11*a* of this embodiment generates the waveform data with the difference fp minimized, based on the frequency characteristic of the resonance sound obtained from the resonance sound generation circuit x24.

Next, electrical configurations of the PC 1 and the electronic piano 2 are described with reference to FIG. 4(*a*) and FIG. 4(*b*). FIG. 4(*a*) is a block diagram showing the electrical configuration of the PC 1. The PC 1 includes a CPU 10, a hard disk drive (referred to as "HDD" hereinafter) 11, and a RAM 12, which are respectively connected with an input/output port 14 via a bus line 13. Moreover, a LCD 15, a mouse 16, a keyboard 17, and the external input/output terminal 18 are connected with the input/output port 14 respectively.

Figure 5:
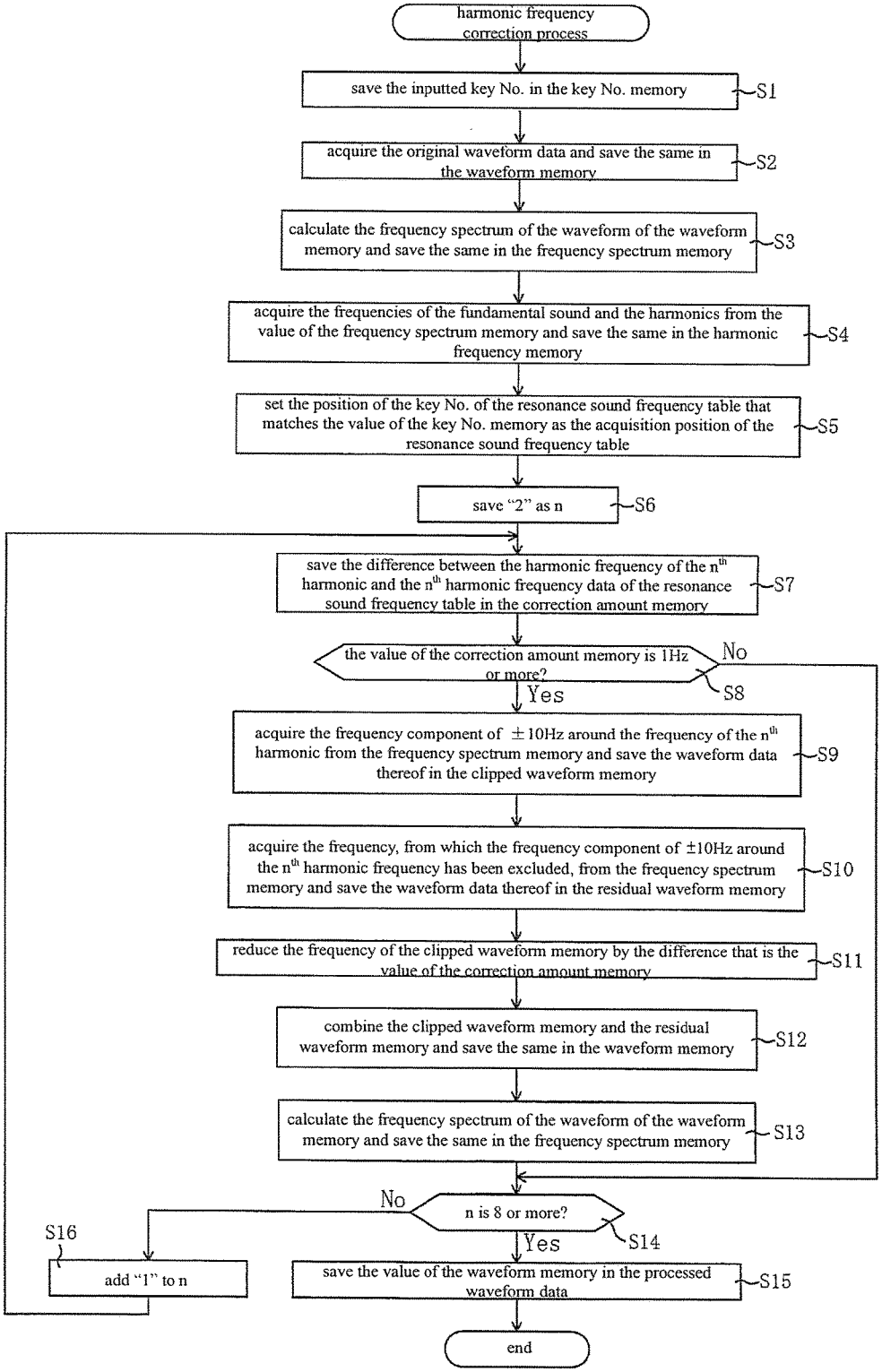
FIG. 5 is a flowchart of the harmonic frequency correction process.

The CPU 10 is an arithmetic device for controlling each component connected via the bus line 13. The HDD 11 is a rewritable non-volatile memory device. The waveform data editing program 11*a*, original waveform data 11*b*, processed waveform data 11*c*, and a resonance sound frequency table 11*d* are respectively provided in the HDD 11. When the waveform data editing program 11*a* is executed by the CPU 10, a harmonic frequency correction process of FIG. 5 is executed.

Waveform data obtained by sampling a performance sound from an instrument, such as the piano, is stored in the original waveform data 11*b*. The sampling is carried out in a state that the instrument is correctly tuned and the frequency of the fundamental sound of the instrument matches a value of fundamental sound frequency data 11*d*1 of the resonance sound frequency table 11*d*, which will be described later. In this embodiment, the waveform data stored in the original waveform data 11*b* is obtained from other PCs or other audio equipment via the external input/output terminal 18, which will be described later. The waveform data stored in the original waveform data 11*b* may also be obtained by sampling a performance sound, which is acquired from a microphone (not shown) connected to the PC 1, by the PC 1.

In the processed waveform data 11*c*, waveform data, which is generated (edited) by the waveform data editing program 11*a* and on which frequency correction has been performed, is stored. The waveform data stored in the processed waveform data 11*c* is stored in the waveform data 23*a* of the electronic piano 2 via the external input/output terminal 18 (which will be described later) and the external input/output terminal 30 of the electronic piano 2. In the performance of the electronic piano 2, the waveform data is transferred from the waveform data 23*a* to the sound source 25, and through processing of the DSP 26, emitted (outputted) by the speaker 29 as a musical sound.

The resonance sound frequency table 11*d* is a table, in which the frequency of the fundamental sound and the frequencies of the harmonics of the resonance sound are stored. In this embodiment, the frequency of the fundamental sound and the frequencies of the harmonics stored in the resonance sound frequency table 11*d* are frequencies where the amplitude reaches the peak in the vicinity of the frequency of the fundamental sound and the frequencies of the harmonics of the resonance sound, which are the same as the peak frequencies of the resonance sound in FIG. 3(*b*). The waveform data editing program 11*a* of this embodiment generates waveform data that matches the frequencies of the harmonics of the resonance sound by correcting the frequencies of the harmonics of the original waveform data 11*b* to the frequencies of the harmonics stored in the resonance sound frequency table 11*d*. The resonance sound frequency table 11*d* is described with reference to FIG. 4(*b*).

FIG. 4(*b*) is a diagram that schematically illustrates the resonance sound frequency table 11*d*. The resonance sound frequency table 11*d* includes the fundamental sound frequency data 11*d*1, second harmonic frequency data 11*d*2, third harmonic frequency data 11*d*3, fourth harmonic frequency data 11*d*4, fifth harmonic frequency data 11*d*5, sixth harmonic frequency data 11*d*6, seventh harmonic frequency data 11*d*7, and eighth harmonic frequency data 11*d*8, which are stored respectively in association with a key No. of the keyboard 24. The key No. is a number that is assigned individually to the keys 24*a* and the keys 24*b* of the keyboard 24. Numbers 21, 22, 23 . . . 108 are assigned in order starting from the key 24*a* and the key 24*b* on the left side of the front of the keyboard 24. A frequency (unit: Hz) at which the amplitude reaches the peak in the vicinity of the frequency of the fundamental sound of the resonance sound generated by the resonance sound generation circuit x24 is stored in the fundamental sound frequency data 11*dl*, and the frequencies (unit: Hz) at which the amplitude reaches the peak in the vicinity of the frequencies of the second to the eighth harmonics of the resonance sound are stored in the second harmonic frequency data 11*d*2 to the eighth harmonic frequency data 11*d*8 respectively. In this embodiment, results obtained by analyzing the resonance sound generated by the resonance sound generation circuit x24 and calculating the frequency of the fundamental sound and the frequencies of multiple harmonics thereof are stored in the fundamental sound frequency data 11*d*1 to the eighth harmonic frequency data 11*d*8.

The waveform data editing program 11*a* searches for a key No. that matches the key No. inputted by the user via the mouse 16 or the keyboard 17 and sets a position of the key No. as an acquisition position of the resonance sound frequency table 11*d*. For example, if the user inputs "60" as the key No., the acquisition position of the resonance sound frequency table 11*d* is key No. 60, and the second harmonic frequency data 11*d*2 to the eighth harmonic frequency data 11*d*8 corresponding to the row of key No. 60 become acquisition targets.

In addition, the waveform data editing program 11*a* compares the frequencies of the fundamental sound and multiple harmonics stored in the resonance sound frequency table 11*d* with the frequencies of the fundamental sound and multiple harmonics of the original waveform data 11*b*. If the difference between these frequencies is 1 Hz or more, the frequency of the fundamental sound or the multiple harmonics of the original waveform data 11*b* is corrected to the frequency of the fundamental sound or the multiple harmonics of the resonance sound frequency table 11*d*.

Reverting to FIG. 4(*a*), the RAM 12 is a memory for rewritably storing various work data or flags, etc. when the CPU 10 executes a program, such as the waveform data editing program 11*a*, and is respectively provided with a waveform memory 12*a*, a frequency spectrum memory 12*b*, a clipped waveform memory 12*c*, a residual waveform memory 12*d*, a harmonic frequency memory 12*e*, a correction amount memory 12*f*, and a key No. memory 12*g*.

The waveform memory 12*a* is a memory that stores the waveform data acquired from the original waveform data 11*b* and stores waveform data after frequency correction of the harmonic with respect to the waveform data. When power for the PC 1 is turned on and immediately after the harmonic frequency correction process of FIG. 5 is executed, the memory is initialized with "0" indicating that no waveform data is stored. Then, at the beginning of the harmonic frequency correction process, the waveform data acquired from the original waveform data 11*b* is stored in the waveform memory 12*a* (S2 of FIG. 5), and with respect to the waveform data, frequency correction is performed for each frequency of the harmonics.

The frequency spectrum memory 12*b* is a memory that stores a frequency spectrum stored in the waveform memory 12*a*. When the power for the PC 1 is turned on and immediately after the harmonic frequency correction process of FIG. 5 is executed, the memory is initialized with "0" indicating that no frequency spectrum is stored. Then, at the beginning of the harmonic frequency correction process of FIG. 5, after the value of the original waveform data 11*b* is stored in the waveform memory 12*a*, and after the waveform data after frequency correction is stored in the waveform memory 12*a*, the frequency spectrum calculated from the waveform data of the waveform memory 12*a* is stored in the frequency spectrum memory 12*b* (S3 and S13 of FIG. 5).

The clipped waveform memory 12*c* is a memory that stores the waveform data holding a frequency component of the harmonic for performing frequency correction in the harmonic frequency correction process of FIG. 5. When the power for the PC 1 is turned on and immediately after the harmonic frequency correction process is executed, the memory is initialized with "0" indicating that no waveform data is stored. In the harmonic frequency correction process, in order to perform frequency correction for each harmonic frequency, a frequency component of ±10 Hz around the harmonic frequency for preforming frequency correction is extracted from the frequency spectrum of the frequency spectrum memory 12*b* and is converted into waveform data to be stored. Then, regarding the waveform data, waveform data with corrected frequency and frequency component that have been stored in the correction amount memory 12*f* is stored (S12 of FIG. 5).

The residual waveform memory 12*d* is a memory that stores waveform data having a frequency component except for the harmonic frequency component for performing frequency correction in the harmonic frequency correction process of FIG. 5. When the power for the PC 1 is turned on and immediately after the harmonic frequency correction process is executed, the memory is initialized with "0" indicating that no waveform data is stored. In the harmonic frequency correction process, a frequency component that does not contain the frequency component of ±10 Hz around the harmonic frequency for performing frequency correction is extracted and converted into waveform data to be stored (S10 of FIG. 5).

The reason for separating the waveform data of the waveform memory 12*a* into the clipped waveform memory 12*c* and the residual waveform memory 12*d* for correction is to perform the frequency correction only on the waveform data of the clipped waveform memory 12*c*. If frequency correction is performed on the waveform data of the waveform memory 12*a*, it will result in a sound of an unintended pitch since the frequency correction is performed on all the waveform data. Therefore, in this embodiment, frequency correction is performed on the waveform data that includes the frequency component for performing frequency correction and the frequencies around it (i.e., the waveform data of the clipped waveform memory 12*c*), which is then combined with the waveform data that has excluded the waveform data for performing frequency correction in advance (i.e., the waveform data of the residual waveform memory 12*d*). Accordingly, it is possible to obtain the waveform data, in which only the target harmonic frequency component is corrected.

The harmonic frequency memory 12*e* is a memory that stores the frequencies of the fundamental sound and the harmonics obtained from the frequency spectrum memory 12*b*. When the power for the PC 1 is turned on and immediately after the harmonic frequency correction process of FIG. 5 is executed, the memory is initialized with "0" indicating that no frequency of the fundamental sound or harmonic is stored. At the beginning of the harmonic frequency correction process, the frequencies of the fundamental sound and the harmonics are analyzed from the frequency spectrum of the waveform data acquired from the original waveform data 11*b*, and these frequencies are stored into the harmonic frequency memory 12*e* in the order of the fundamental sound→the second harmonic→the third harmonic→ . . . →the eighth harmonic (S4 of FIG. 5). The frequencies of the second harmonic to the eighth harmonic stored in the harmonic frequency memory 12*e* and the second harmonic frequency data 11*d*2 to the eighth harmonic frequency data 11*d*8 of the resonance sound frequency table 11*d* are compared with each other respectively, and if the difference therebetween is 1 Hz or more, the frequency of the waveform data stored in the clipped waveform memory 12*c* is corrected by a value of the correction amount memory 12*f*, which will be described later.

The correction amount memory 12*f* is a memory that stores a correction amount (unit: Hz) for performing frequency correction with respect to the waveform data of the clipped waveform memory 12*c*. When the power for the PC 1 is turned on and immediately after the harmonic frequency correction process of FIG. 5 is executed, the memory is initialized with "0." The correction amount memory 12*f* stores a difference between the frequency of the harmonic stored in the clipped waveform memory 12*c* and the frequency of the corresponding harmonic among the second harmonic frequency data 11*d*2 to the eighth harmonic frequency data 11*d*8 of the resonance sound frequency table 11*d* (S7 of FIG. 5). In addition to being used as the correction amount for performing frequency correction, the value of the correction amount memory 12*f* is also used for determining whether to perform frequency correction (S8 of FIG. 5).

The key No. memory 12*g* is a memory that stores the key No. of the keyboard 24 inputted by the user. When the power for the PC 1 is turned on and immediately after the harmonic frequency correction process of FIG. 5 is executed, the memory is initialized with "0." The key No. is a number that is assigned individually to the keys 24*a* and the keys 24*b* of the keyboard 24. Numbers 21, 22, 23 . . . 108 are assigned in order starting from the key 24*a* and the key 24*b* on the left side of the front of the keyboard 24. In the harmonic frequency correction process, the key No. inputted by the mouse 16 or the keyboard 17 is stored in the key No. memory 12*g* (S1 of FIG. 5). A position (row) where the value of the key No. memory 12*g* and the key No. of the resonance sound frequency table 11*d* match each other is the position for acquiring the second harmonic frequency data 11*d*2 to the eighth harmonic frequency data 11*d*8 of the resonance sound frequency table 11*d*.

The LCD 15 is a display for displaying a display screen. The mouse 16 and the keyboard 17 are input devices for inputting an instruction from the user or information to the PC 1. In the harmonic frequency correction process of FIG. 5, the key No. of the keyboard 24 is inputted by the user via the mouse 16 or the keyboard 17.

The external input/output terminal 18 is an interface for transmitting and receiving data between the PC 1 and the electronic piano 2 or other computers. The waveform data stored in the processed waveform data 11*c* of the PC 1 is transmitted to the electronic piano 2 via the external input/output terminal 18. In addition, the waveform data generated by other PCs or other audio equipment is received by the PC 1. The data may also be transmitted and received by network connection via LAN (not shown), or be transmitted and received via the Internet, instead of the external input/output terminal 18.

Next, the electrical configuration of the electronic piano 2 is described with reference to FIG. 4(*c*). FIG. 4(*c*) is a block diagram showing the electrical configuration of the electronic piano 2. The electronic piano 2 includes a CPU 20, a ROM 21, a RAM 22, a flash memory 23, a keyboard 24, a sound source 25, a DSP 26, and an external input/output terminal 30, which are respectively connected via a bus line 31. A digital-to-analog converter (DAC) 27 is connected with the DSP 26. The DAC 27 is connected with an amplifier 28, and the amplifier 28 is connected with a speaker 29.

The CPU 20 is an arithmetic device for controlling each component connected via the bus line 31. The ROM 21 is a non-rewritable memory and stores control programs (not shown) to be executed by the CPU 20 or the DSP 26 or fixed value data (not shown) to be referred to by the CPU 20 when the control programs are executed. The RAM 22 is a rewritable volatile memory and has a temporary area for temporarily storing various data as the CPU 20 executes the control programs (not shown).

The flash memory 23 is a rewritable non-volatile memory and is provided with waveform data 23*a*. Waveform data corresponding to each key that constitutes the keyboard 24 is stored in the waveform data 23*a*.

The sound source 25 is a sound source that reads waveform data corresponding to musical sound information inputted from the CPU 20 based on a key depression of the keyboard 24 from the waveform data 23*a* and inputs the same into the DSP 26 to start reproduction of a musical sound.

The DSP 26 is an arithmetic device for processing the waveform data inputted from the sound source 25. In this embodiment, the waveform data 23*a* is inputted to the resonance sound generation circuit x24 (refer to FIG. 1) configured in the DSP 26, so as to generate a resonance sound. The resonance sound generation circuit x24 includes a conventional "delay feedback circuit." The delay feedback circuit includes a circuit that combines a delay line and an APF for adjusting a base frequency of the resonance sound, and an APF for forming inharmonicity. Furthermore, the DSP 26 also performs a process of mixing the waveform data of the generated resonance sound with the inputted waveform data 23*a*. The DSP 26 inputs the waveform data after the processing to the DAC 27.

The DAC 27 converts the waveform data inputted by the DSP 26 into analog waveform data. The amplifier 28 amplifies the analog waveform data converted by the DAC 27 by a predetermined gain. The speaker 29 reproduces the analog waveform data amplified by the amplifier 28 and emits (outputs) it as a musical sound.

The external input/output terminal 30 is an interface for transmitting and receiving data of the electronic piano 2 and the PC 1. The waveform data generated by the PC 1 is received via the external input/output terminal 30, and the received waveform data is stored in the waveform data 23*a*. Like the external input/output terminal 18 of the PC 1, the data may also be transmitted and received by network connection via LAN (not shown), or be transmitted and received via the Internet, instead of the external input/output terminal 30.

Figure 6A:
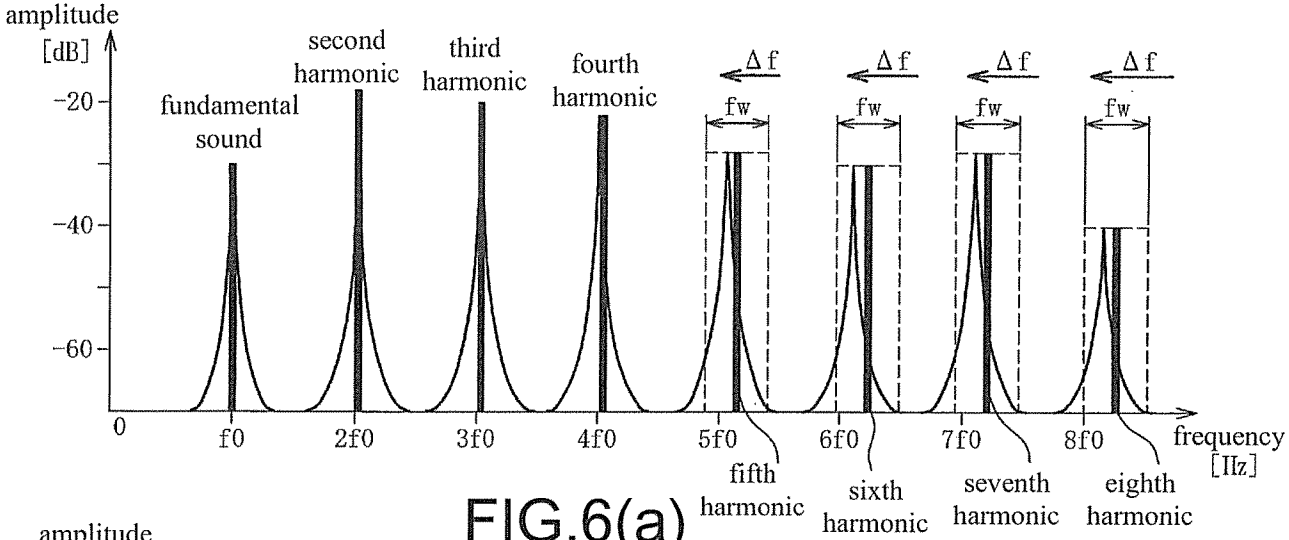
FIG. 6(*a*) is a graph showing the frequency spectrum of the piano sound before frequency correction and the resonance characteristic of the resonance sound generated by the resonance sound generation circuit.
Figure 6B:
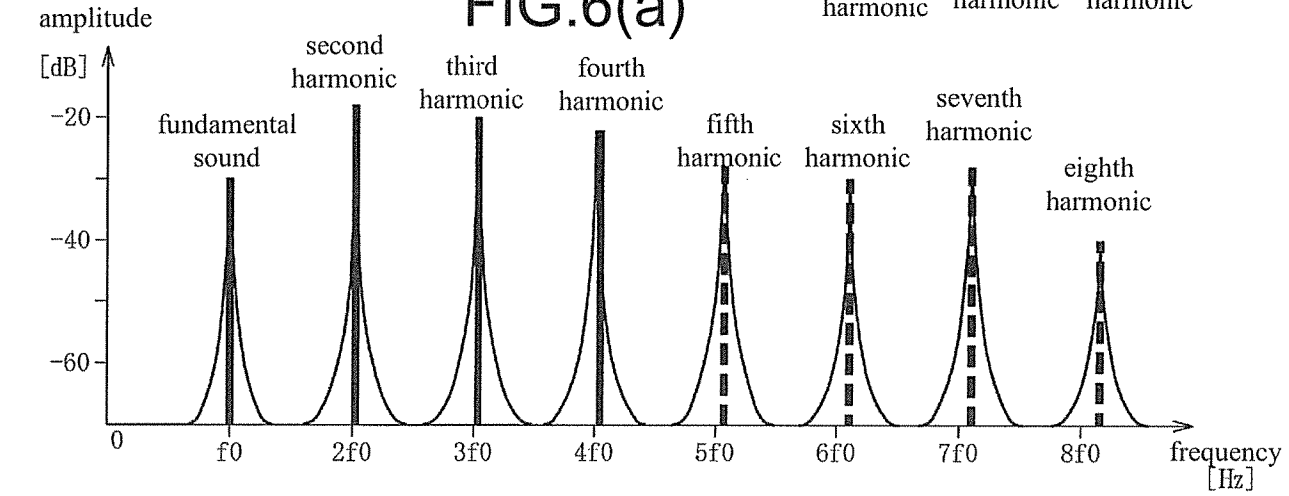

Next, the waveform data editing program 11*a* executed by the CPU 10 of the PC 1 is described with reference to FIG. 5, FIG. 6(*a*), and FIG. 6(*b*). FIG. 5 is a flowchart of the harmonic frequency correction process of the waveform data editing program 11*a*. By performing the harmonic frequency correction process, the harmonic frequency of the waveform data (referred to as original waveform data hereinafter) obtained according to the frequency of the resonance sound generated by the resonance sound generation circuit x24 of the electronic piano 2 is corrected, so as to generate waveform data that matches the frequency of the resonance sound from the resonance sound generation circuit x24. The harmonic frequency correction process is executed when the original waveform data 11*b* that is to be corrected is designated by the user by the mouse 16 or the keyboard 17.

First, the key No. inputted by the user is saved in the key No. memory 12*g* (S1). Specifically, the key No. corresponding to the original waveform data 11*b* is saved in the key No. memory 12*g* by the user's operation of the mouse 16 or the keyboard 17. Next, the waveform data of the original waveform data 11*b* is acquired and saved in the waveform memory 12*a* (S2). After the process of S2, the frequency spectrum of the waveform of the waveform memory 12*a* is calculated and saved in the frequency spectrum memory 12*b* (S3). The frequency spectrum of the waveform refers to the amplitude with respect to each frequency (refer to FIG. 3(*a*)), and is calculated by applying a known discrete Fourier transform on the waveform of the waveform memory 12*a*.

After the process of S3, the frequencies of the fundamental sound and the harmonics are acquired from the value of the frequency spectrum memory 12*b* and saved in the harmonic frequency memory 12*e* (S4). A method of acquiring the frequencies of the fundamental sound and the harmonics may include, from the frequency spectrum of the frequency spectrum memory 12*b*, setting the frequency at the peak of the amplitude as the frequency of the fundamental sound, the frequency of the second harmonic, . . . , and the frequency of the eighth harmonic respectively in an ascending order of the frequencies. The acquired frequencies of the fundamental sound and the harmonics are saved in the harmonic frequency memory 12*e* in the following order: the frequency of the fundamental sound→the frequency of the second harmonic→ . . . →the frequency of the eighth harmonic.

After the process of S4, the position of the key No. of the resonance sound frequency table 11*d* that matches the key No. memory 12*g* is set as the acquisition position of the resonance sound frequency table 11*d* (S5). Specifically, the key No. of the resonance sound frequency table 11*d* is searched based on the value of the key No. memory 12*g*, and the row where a match is found is set as the acquisition position of the resonance sound frequency table 11*d* in the process of S7, which will be described later.

After the process of S5, "2" is saved as n (S6). n is a positive integer not including 1. Hereinafter, "$n^{th}$ harmonic" respectively represents "the second harmonic" if the value of n is 2, "the third harmonic" if the value of n is 3, . . . , and "the eighth harmonic" if the value of n is 8. Moreover, "$n^{th}$ harmonic frequency data" respectively represents "the second harmonic frequency data 11*d*2 of the resonance sound frequency table 11*d*" if the value of n is 2, "the third harmonic frequency data 11*d*3 of the resonance sound frequency table 11*d*" if the value of n is 3, . . . , and "the eighth harmonic frequency data 11*d*8 of the resonance sound frequency table 11*d*" if the value of n is 8.

After the process of S6, the difference between the frequency of the $n^{th}$ harmonic and the $n^{th}$ harmonic frequency data of the resonance sound frequency table 11*d* is saved in the correction amount memory 12*f* (S7). Specifically, the difference between the frequency of the $n^{th}$ harmonic stored in the harmonic frequency memory 12*e* and the frequency of the $n^{th}$ harmonic frequency data of the resonance sound frequency table 11*d* at the acquisition position determined by S5 is calculated and saved in the correction amount memory 12*f*. The value stored in the correction amount memory 12*f* corresponds to the difference fp between the frequency of the $n^{th}$ harmonic in FIG. 3(*b*) and the frequency of the resonance sound of the $n^{th}$ harmonic. The value of the correction amount memory 12*f* is used as the correction amount when determining whether to perform frequency correction on the $n^{th}$ harmonic (S8 as described hereinafter) or when performing frequency correction.

After the process of S7, whether the value of the correction amount memory 12*f* is 1 Hz or more is confirmed (S8). In this embodiment, if the value of the correction amount memory 12*f*, i.e., the difference between the frequency of the $n^{th}$ harmonic and the $n^{th}$ harmonic frequency data of the resonance sound frequency table 11*d*, is 1 Hz or more, it is set as the harmonic for correcting frequency to perform the frequency correction process after S9.

If the value of the correction amount memory 12*f* is 1 Hz or more (S8: Yes), the frequency component of ±10 Hz around the frequency of the $n^{th}$ harmonic is acquired from the frequency spectrum memory 12*b* and the waveform data thereof is saved in the clipped waveform memory 12*c* (S9). After the process of S9, the frequency excluding the frequency component of ±10 Hz around the frequency of the $n^{th}$ harmonic is acquired from the frequency spectrum memory 12*b* and the waveform data thereof is saved in the residual waveform memory 12*d* (S10). After the process of S10, the frequency of the clipped waveform memory 12*c* is reduced by an amount of the difference that is the value of the correction amount memory 12*f* (S11). After the process of S11, the clipped waveform memory 12*c* and the residual waveform memory 12*d* are combined and saved in the waveform memory 12*a* (S12).

The processes of S9 to S12 are described with reference to FIG. 6(*a*) and FIG. 6(*b*). FIG. 6(*a*) is a graph showing the frequency spectrum of the piano sound before the frequency correction and the resonance characteristic of the resonance sound generated by the resonance sound generation circuit x24. Same as FIG. 3(*b*), the horizontal axis indicates the frequency (Hz) and the vertical axis indicates the amplitude (dB), and the amplitude characteristic of each frequency of the fundamental sound and the multiple harmonics of the piano is represented by a thick line while the amplitude characteristic of each frequency of the resonance sound of the fundamental sound and the multiple harmonics is represented by a solid line. In FIG. 6(*a*), regarding the fifth harmonic to the eighth harmonic, the difference between the frequency of the $n^{th}$ harmonic and the $n^{th}$ harmonic frequency data of the resonance sound frequency table 11*d* is 1 Hz or more, and the correction amount (i.e., the value of the correction amount memory 12*f*) for performing frequency correction is Δf.

In S9, the waveform data to be saved in the clipped waveform memory 12*c* uses the frequency component having a frequency width fw of ±10 Hz around the frequency of the $n^{th}$ harmonic (that is, the frequency width fw is 20 Hz) as the waveform. The reason of using the frequency component having the frequency width fw as the waveform is that the sound of the $n^{th}$ harmonic includes not only the sound of the frequency component of the $n^{th}$ harmonic but also the frequency components before and after it so as to present the specific tone of the instrument, and discomfort is minimized when the user hears the sound of the $n^{th}$ harmonic after frequency correction. The frequency width of the frequency width fw is set to 20 Hz in this embodiment. However, the frequency width may be set less than or more than 20 Hz according to the characteristics of each instrument.

Next, in the process of S10, the waveform of the frequency component, other than the waveform that has been saved in the clipped waveform memory 12*c* in the process of S9, is saved in the residual waveform memory 12*d*. Referring to FIG. 6(*a*), in the case of performing the frequency correction on the sound of the fifth harmonic, for example, the waveform of the frequency component having the frequency width fw around the fifth harmonic is saved in the clipped waveform memory 12*c* while the waveform of the frequency component other than the frequency width fw around the fifth harmonic is saved in the residual waveform memory 12*d*.

In this embodiment, in the process of S11, the frequency correction is performed on the waveform of the clipped waveform memory 12*c*. The reason is that if the frequency correction is performed on the waveform that includes all the frequency components, it will result in a sound of an unintended pitch since all the frequency components are corrected. Therefore, the frequency correction is performed only on the waveform that includes the frequency component for performing frequency correction, that is, the waveform of the clipped waveform memory 12*c*. Then, in the process of S12, the waveform of the clipped waveform memory 12*c* and the waveform of the residual waveform memory 12*d* are combined. Thereby, the waveform that the frequency correction has been performed only on the frequency component of the harmonic to be corrected is obtained.

A method of performing the frequency correction is explained below. The waveform saved in the clipped waveform memory 12*c* is P(t), and a waveform obtained by rotating a phase of P(t) 90° is Q(t). t is the time (second). When the frequency correction amount is Δf, the sampling frequency is fs, and $\omega=2\pi\Delta f/fs$, a waveform Y(t) after the frequency correction is represented by the Equation 1.

$$Y(t)=P(t)\cos\omega t+Q(t)\sin\omega t \quad \text{(Equation 1)}$$

$\omega=2\pi\Delta f/fs$

In this embodiment, the frequency correction amount Δf is the value of the correction amount memory 12*f*, and the sampling frequency fs is 44100 Hz. The waveform Y(t) is obtained by adding P(t), the waveform saved in the clipped waveform memory 12*c*, and Q(t), the waveform obtained by rotating the phase of P(t) 90°. Then, a product of P(t) multiplied by cos ωt and a product of Q(t) multiplied by sin ωt are added, so as to shift the frequency of P(t) by Δf and thereby correct the frequency. The waveform of Y(t) calculated by the Equation 1 is saved in the clipped waveform memory 12*c*.

Then, by the process of S12, the waveform obtained by combining the clipped waveform memory 12*c* and the residual waveform memory 12*d* is saved in the waveform memory 12*a*. FIG. 6(*b*) is a graph showing the frequency spectrum of the piano sound after the frequency correction and the resonance characteristic of the resonance sound generated by the resonance sound generation circuit x24. Same as FIG. 6(*a*), the horizontal axis indicates the frequency and the vertical axis indicates the amplitude, and the amplitude characteristic of each frequency of the fundamental sound and the multiple harmonics of the piano is represented by a thick line while the amplitude characteristic of each frequency of the resonance sound of the fundamental sound and the multiple harmonics is represented by a solid line. The amplitude characteristic of each frequency of the harmonic after the frequency correction is represented by a thick dotted line. As shown in FIG. 6(*b*), the frequency of the $n^{th}$ harmonic after the frequency correction and the peak frequency of the resonance sound substantially coincide with each other and the difference is eliminated. Accordingly, by playing the electronic piano 2, the sound after the frequency correction and the resonance sound achieve resonance easily, and even if interference occurs, "beat" is suppressed and a piano performance including interference that is favorable to the user or audience becomes achievable.

Reverting to FIG. 5, after the process of S12, the frequency spectrum of the waveform of the waveform memory 12*a* is calculated and saved in the frequency spectrum memory 12*b* (S13). The corrected clipped waveform memory 12*c* and the residual waveform memory 12*d* are combined and saved in the waveform memory 12*a*, and the frequency spectrum of the waveform memory 12*a* is calculated and saved in the frequency spectrum memory 12*b*. Thus, the next frequency correction process for the $n^{th}$ harmonic is performed based on the waveform memory 12*a* and the frequency spectrum memory 12*b* that have undergone the previous frequency correction process for the $n^{th}$ harmonic.

In S8, if the value of the correction amount memory 12*f* is less than 1 Hz (S8: No), the processes of S9 to S13 are skipped. After the processes of S8 and S13, whether n is 8 or more is confirmed (S14). If n is 8 or more, the value of the waveform memory 12*a* is saved in the processed waveform data 11*c* (S15) and this process ends.

In this embodiment, in order to perform the frequency correction till the eighth harmonic, if n is less than the upper limit, i.e., 8, 1 is added to n (S16) to perform the process of S7, so as to perform the next $n+1^{th}$ harmonic frequency correction process. On the other hand, if n is 8 or more, since there is no harmonic for performing frequency correction thereafter, the value of the waveform memory 12*a* is saved in the processed waveform data 11*c* and this process ends.

As described above, the waveform data editing program 11*a* of this embodiment acquires the original waveform data 11*b* and calculates the frequency spectrum of the acquired waveform data. The difference between the harmonic frequency of the $n^{th}$ harmonic (n is a positive integer not including 1) of the calculated frequency spectrum and the resonance sound frequency of the $n^{th}$ harmonic generated by the resonance sound generation circuit x24 is calculated. If the calculated difference is 1 Hz or more, the waveform of the frequency component of 20 Hz centered on the frequency of the $n^{th}$ harmonic of the frequency spectrum is clipped. The clipped waveform is reduced by the calculated difference. The corrected waveform and the clipped original waveform are combined.

The frequency of the $n^{th}$ harmonic of the corrected waveform data is edited to eliminate the difference with the resonance frequency of the $n^{th}$ harmonic of the resonance sound generation circuit x24 that uses the waveform data. Thus, there is no difference between the frequency of the $n^{th}$ harmonic of the sampling sound source and the resonance frequency of the $n^{th}$ harmonic of the resonance sound generated by the resonance sound generation circuit x24 by resonating the waveform data. Resonance is achieved easily and occurrence of beat of the sound is also prevented. In addition, since the frequency of the $n^{th}$ harmonic of the waveform data is edited to match the resonance frequency of the $n^{th}$ harmonic of the resonance sound generation circuit x24 that uses the waveform data, multiple resonance circuits or high-order APFs are not required and costs of the resonance sound generation circuit x24 are reduced.

The above illustrates the invention on the basis of the embodiments. However, it should be understood that the invention is not limited to any of the aforementioned embodiments, and various modifications or alterations may be made without departing from the spirit of the invention.

In this embodiment, the harmonic for performing frequency correction is the eighth harmonic. Nevertheless, the invention is not limited thereto. The invention is also applicable to frequency correction for harmonics higher than or lower than the eighth harmonic. In that case, the number of the harmonic frequency data to be stored in the resonance sound frequency table 11*d* and the value to be compared with n in the process of S14 of FIG. 5 ("8" in this embodiment) are increased or decreased according to the number of the harmonics for performing frequency correction.

In this embodiment, the electronic piano is given as an example to describe the waveform data editing program 11*a*. However, the invention is not limited thereto and the invention is also applicable to the simulation of a stringed instrument, a wind instrument, a percussion instrument, and so on that generates a resonance sound. In that case, it is not necessary to make the frequency of the harmonic coincide with the frequency of the resonance sound, and the value stored in the resonance sound frequency table 11*d* may be changed according to the characteristics of the simulated instrument or the characteristics of the resonance sound generation circuit for generating the resonance sound.

In this embodiment, the configuration is made such that the processed waveform data 11*c* edited by the waveform data editing program 11*a* is stored in the waveform data 23*a* of the electronic piano 2 via the external input/output terminal 18 and the external input/output terminal 30 of the electronic piano 2, and the waveform data is transferred to the sound source 25 during the performance of the electronic piano 2, and through processing of the DSP 26, emitted (outputted) by the speaker 29 as a musical sound. However, the invention is not limited thereto. The processed waveform data 11*c* edited by the waveform data editing program 11*a* may also be written to an IC chip in the production process, which is then installed in the electronic piano 2 for outputting the waveform data in the IC chip as a musical sound.

In this embodiment, the memory device is the flash memory 23 which stores the waveform data 23*a*, for example. However, the invention is not limited thereto, and a device that directly stores the waveform data 23*a* in the sound source 25 may be used as the sound source (memory device).

In this embodiment, the waveform data editing program 11*a* executes all the steps as one single program to output the edited waveform data. However, the invention is not limited thereto. The steps of the waveform data editing program 11*a* may be executed separately to output the final edited waveform data.

What is claimed is:

1. An electronic device adapted to edit waveform data to store in a memory device, wherein the memory device is adapted for a resonance sound generation circuit, the electronic device comprising:

a processor performing the following steps to generate an edited waveform data, wherein the edited waveform data is applied to an instrument and eliminates a difference between a harmonic frequency of a $n^{th}$ harmonic and a resonance sound frequency of the $n^{th}$ harmonic of the resonance sound generation circuit:

a waveform acquisition step of acquiring waveform data comprising a fundamental sound and the $n^{th}$ harmonic obtained by sampling a musical sound;

a spectrum calculation step of calculating a frequency spectrum of the waveform data acquired by the waveform acquisition step;

a difference calculation step of calculating a difference between the harmonic frequency of the $n^{th}$ harmonic of the frequency spectrum calculated by the spectrum calculation step and the resonance sound frequency of the $n^{th}$ harmonic of the resonance sound generation circuit according to a resonance sound frequency table stored in the electronic device; and a difference reduction step of performing a reduction process of the difference between the frequencies on a waveform of a frequency component having a second predetermined frequency width centered on the frequency of the $n^{th}$ harmonic of the frequency spectrum if the difference calculated by the difference calculation step is equal to or more than a first predetermined frequency difference, wherein n is a positive integer not including 1.

2. The electronic device according to claim 1, wherein the difference reduction step comprises:

a waveform clipping step of clipping the waveform of the frequency component having the second predetermined frequency width centered on the frequency of the $n^{th}$ harmonic of the frequency spectrum from the frequency spectrum if the difference calculated by the difference calculation step is equal to or more than the first predetermined frequency difference;

a waveform correction step of performing the reduction process of the difference calculated by the difference calculation step on the waveform clipped by the waveform clipping step; and a waveform combination step of combining the waveform corrected by the waveform correction step with the original waveform clipped by the waveform clipping step.

3. The electronic device according to claim 2, wherein the waveform correction step performs the correction by the following equation 1 where a frequency of the difference calculated by the difference calculation step is x Hz, the waveform clipped by the waveform clipping step is P(t), a waveform obtained by rotating a phase of P(t) 90° is Q(t), and the corrected waveform is Y(t):

$$Y(t)=P(t)\cos \omega t+Q(t)\sin \omega t \qquad \text{equation 1}$$

wherein $\omega=2\pi x/fs$, and fs represents a sampling frequency of the resonance sound generation circuit.

4. The electronic device according to claim 1, wherein the first predetermined frequency difference is less than a frequency of the second predetermined frequency width.

5. A waveform data editing method adapted for a resonance sound generation circuit, wherein the waveform data editing method is performed by a processor of an electronic device to generate an edited waveform data, wherein the edited waveform data is applied to an instrument and eliminates a difference between a harmonic frequency of a $n^{th}$ harmonic and a resonance sound frequency of the $n^{th}$ harmonic of the resonance sound generation circuit, and the method comprises:

a waveform acquisition step of acquiring waveform data obtained by sampling a musical sound;

a spectrum calculation step of calculating a frequency spectrum of the waveform data acquired by the waveform acquisition step;

a difference calculation step of calculating a difference between a harmonic frequency of an $n^{th}$ harmonic of the frequency spectrum calculated by the spectrum calculation step and a resonance sound frequency of the $n^{th}$ harmonic of the resonance sound generation circuit according to a resonance sound frequency table stored in the electronic device; and a difference reduction step of performing a reduction process of the difference between the frequencies on a waveform of a frequency component having a second predetermined frequency width centered on the frequency of the $n^{th}$ harmonic of the frequency spectrum if the difference calculated by the difference calculation step is equal to or more than a first predetermined frequency difference, wherein n is a positive integer not including 1.

6. The waveform data editing method according to claim 5, wherein the difference reduction step comprises:

a waveform clipping step of clipping the waveform of the frequency component having the second predetermined frequency width centered on the frequency of the $n^{th}$ harmonic of the frequency spectrum from the frequency spectrum if the difference calculated by the difference calculation step is equal to or more than the first predetermined frequency difference;

a waveform correction step of performing the reduction process of the difference calculated by the difference calculation step on the waveform clipped by the waveform clipping step; and a waveform combination step of combining the waveform corrected by the waveform correction step with the original waveform clipped by the waveform clipping step.

7. A resonance sound generating method, comprising:

splitting an inputted waveform into a first waveform and a second waveform;

amplifying the first waveform and the second waveform; and generating a resonance sound by utilizing an edited waveform data generated by the waveform data editing method of claim 5 to adjust the second waveform.

8. A resonance sound generating system, comprising:

an electronic device adapted to edit waveform data, the electronic device comprises a processor performing the following steps to generate an edited waveform data:

a waveform acquisition step of acquiring waveform data comprising a fundamental sound and an $n^{th}$ harmonic obtained by sampling a musical sound;

a spectrum calculation step of calculating a frequency spectrum of the waveform data acquired by the waveform acquisition step;

a difference calculation step of calculating a difference between a harmonic frequency of the $n^{th}$ harmonic of the frequency spectrum calculated by the spectrum calculation step and a resonance sound frequency of the $n^{th}$ harmonic of the resonance sound generation circuit according to a resonance sound frequency table stored in the electronic device; and a difference reduction step of performing a reduction process of the difference between the frequencies on a waveform of a frequency component having a second predetermined frequency width centered on the frequency of the $n^{th}$ harmonic of the frequency spectrum if the difference calculated by the difference calculation step is equal to or more than a first predetermined frequency difference, wherein n is a positive integer not including 1; and an instrument comprising:

a memory device, wherein the memory device stores the edited waveform data edited by the processor of the electronic device, and is adapted for a resonance sound generation circuit;

a resonance sound generation circuit, wherein the edited waveform data is inputted to the resonance sound generation circuit to generate a resonance sound;

a digital-to-analog converter, the digital-to-analog converter converts a waveform data inputted by the resonance sound generation circuit into analog waveform data;

an amplifier, the amplifier amplifies the analog waveform data converted by the digital-to-analog converter by a predetermined gain; and a speaker, the speaker reproduces the analog waveform data amplified by the amplifier and emits it as a musical sound.

* * * * *